US005901558A

United States Patent [19]

Mattéet al.

[11] Patent Number: 5,901,558

[45] Date of Patent: May 11, 1999

[54] WATER PUMP WITH INTEGRAL GATE VALVE

[75] Inventors: Stephen R. Matté, Norfolk; Alan L. Weeks, S. Easton, both of Mass.

[73] Assignee: Helix Technology Corporation, Mansfield, Mass.

[21] Appl. No.: 08/915,035

[22] Filed: Aug. 20, 1997

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,464,223 | 9/1969 | Roberts et al. | 62/55.5 |
| 3,485,054 | 12/1969 | Hogan et al. | 62/55.5 |
| 3,579,997 | 5/1971 | Rapinat | 62/55.5 |
| 4,214,853 | 7/1980 | Mahl | 417/154 |
| 4,311,018 | 1/1982 | Welch | 62/55.5 |
| 4,449,373 | 5/1984 | Peterson et al. | 62/55.5 |
| 4,614,093 | 9/1986 | Bachler et al. | 62/55.5 |
| 4,873,833 | 10/1989 | Pfeiffer et al. | 62/55.5 |
| 5,261,244 | 11/1993 | Lessard et al. | 62/55.5 |
| 5,483,803 | 1/1996 | Matté et al. | 62/55.5 |
| 5,548,964 | 8/1996 | Jinbo et al. | 62/55.5 |

FOREIGN PATENT DOCUMENTS

| | | |
|---|---|---|
| 0397051 | 11/1990 | European Pat. Off. . |
| 0610666A1 | 8/1994 | European Pat. Off. . |

OTHER PUBLICATIONS

Mundinger, H.J., et al., "Fast Cryopump Regeneration Does More Than Save Time," *Semiconductor International*, pp. 154–156 (Jul. 1993).

Power, B. D., et al., "Single Structure Vapour Pumping Groups," Paper presented at the Third Israeli Vacum Congress, Pp. 117–122 (Sep. 1973).

Dennis, N.T.M., et al., "Further Developments with Single Structure Vapour Pumping Groups," Vacuum, vol. 28, No. 12, pp. 551–558.

Osterstrom, G. E. and Shapiro, A. II, "Improved Turbomolecular Pump," *The Journal of Vacuum Science and Technology*, Fifth Intern'l. Vacuum Congress Proceedings Issue, pp. 405–408 (Jan./Feb. 1972).

Power, B. D., "Abstract: Diffstaks with Integral Cold Traps", *Journal of Vacuum Science & Technology*, vol. 15, No. 2 (Mar./Apr. 1978).

Photograph from CTI–Cryogenics Manual.

Drawing from CTI–Cryogenics Manual.

*Primary Examiner*—Ronald Capossela
*Attorney, Agent, or Firm*—Hamilton, Brook, Smith & Reynolds, P.C.

[57] ABSTRACT

A cold trap includes a fluid conduit having a fluid flow path therethrough, a length along the fluid flow path and a width transverse to the fluid flow path. The width of the fluid conduit is greater than the length. A gate valve is formed integrally with the fluid flow conduit for opening and closing the fluid flow path. A cryopumping array having an outer rim surrounding a central opening is positioned within the fluid conduit downstream from the gate valve and transverse to the fluid flow path such that the fluid flow path extends through the central opening. The outer rim captures water vapor from the fluid flow path.

21 Claims, 8 Drawing Sheets

WATER PUMP WITH INTEGRAL GATE VALVE

BACKGROUND

Vacuum pumps such as turbomolecular vacuum pumps are often employed for evacuating process chambers used in manufacturing. Although turbomolecular pumps are efficient in removing many gases from process chambers, they are not efficient for pumping water vapor. As a result, cold traps are commonly mounted in-line between the turbomolecular pump and the process chamber for improving the water pumping capabilities. Such cold traps remove water vapor from the process chamber by condensing the water vapor on a cryopumping array positioned in the fluid flow path.

Most cold traps include a fluid conduit having flanges at opposite ends for mounting in-line between the process chamber and the turbomolecular pump. The cryopumping array is positioned within the fluid conduit and is cooled by a cryogenic refrigerator. Some cold traps are designed to provide minimal flow resistance for non-condensing gases passing therethrough such as nitrogen and argon by employing a thin walled tubular cryopumping array. The most common tubular array is about 8 inches in diameter by 6 inches long. A tubular array of this size results in a cold trap having a fluid conduit about 9 inches long. The water vapor condenses along the surfaces of the tubular array while allowing the non-condensing gases to pass substantially unrestricted through the open center of the array. Typically, a gate valve is mounted between the cold trap and work chamber to permit isolation of the two.

SUMMARY OF THE INVENTION

Occasionally, situations arise where space is limited and there is not enough room for mounting a conventional in-line cold trap between the turbomolecular pump and the process chamber. The present invention provides a compact cold trap suitable for use in such situations. The cold trap of the present invention includes a fluid conduit having a fluid flow path therethrough, a length along the fluid flow path and a width transverse to the fluid flow path. The width of the fluid conduit is greater than the length. A gate valve is formed integrally with the fluid conduit for opening and closing the fluid flow path. A cryopumping array having an outer rim surrounding a central opening is positioned within the fluid conduit downstream from the gate valve and transverse to the fluid flow path such that the fluid flow path extends through the central opening. Water vapor from the fluid flow path is captured by the outer rim.

In preferred embodiments, the fluid conduit of the cold trap is coupled between a process chamber and a vacuum pump. The vacuum pump is preferably a turbomolecular pump and captures gases passing through the fluid conduit. The array is preferably an optically open flat annular member formed from sheet metal. The array has thickness selected to maintain a desired temperature gradient, a transverse width and a rim width with both the transverse width and the rim width being greater than the thickness. A conductive strut conductively couples a cryogenic refrigerator to the array for cooling the array. The gate valve includes a solenoid operated valve member. The valve member is moved by the solenoid across the fluid flow path to open and close the fluid flow path.

The present invention increases the water pumping speed of vacuum pumps such as turbomolecular pumps while only minimally increasing the length of the fluid flow path and at the same time minimally obstructing the flow of non-condensing gases into the turbomolecular pump. In addition, the present invention allows the use of a cold trap and gate valve in situations where space constraints previously did not allow the use of a cold trap either alone or in combination with a gate valve.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figure 1:
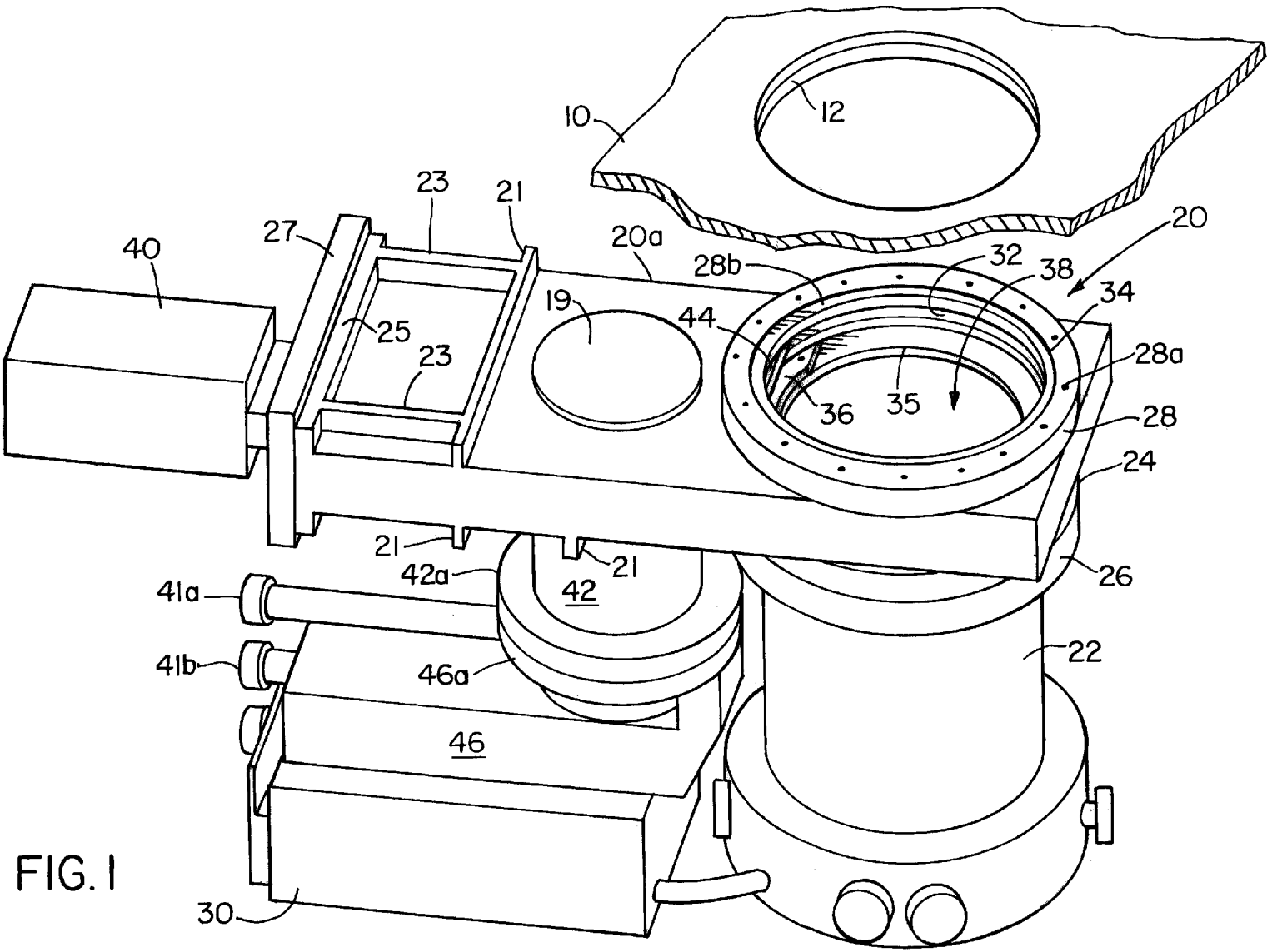
FIG. 1 is a perspective view of the present invention water pump with integral gate valve which is coupled to a turbomolecular pump and positioned below a portion of a process chamber.
Figure 2:
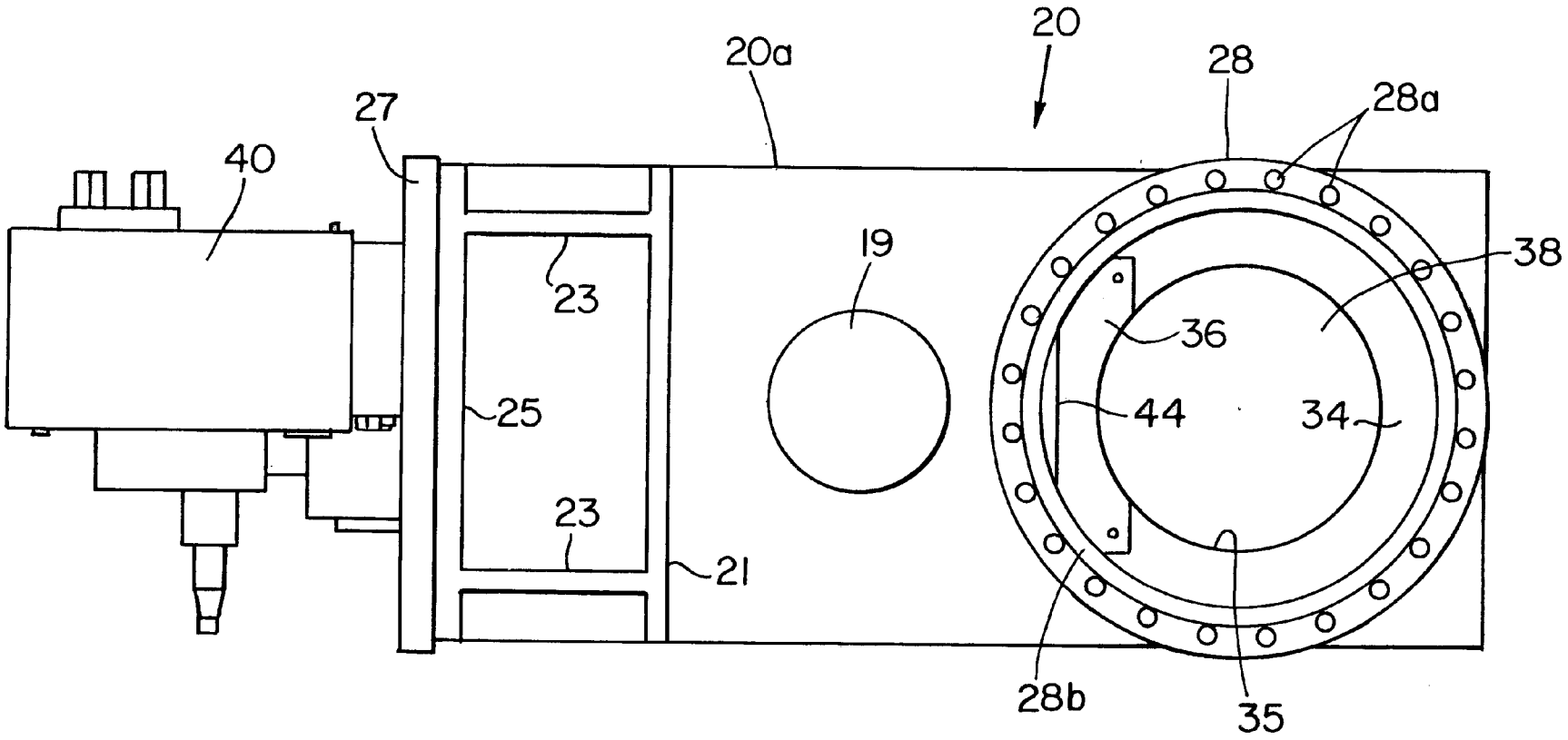
FIG. 2 is a front view of the present invention water pump.
Figure 3:
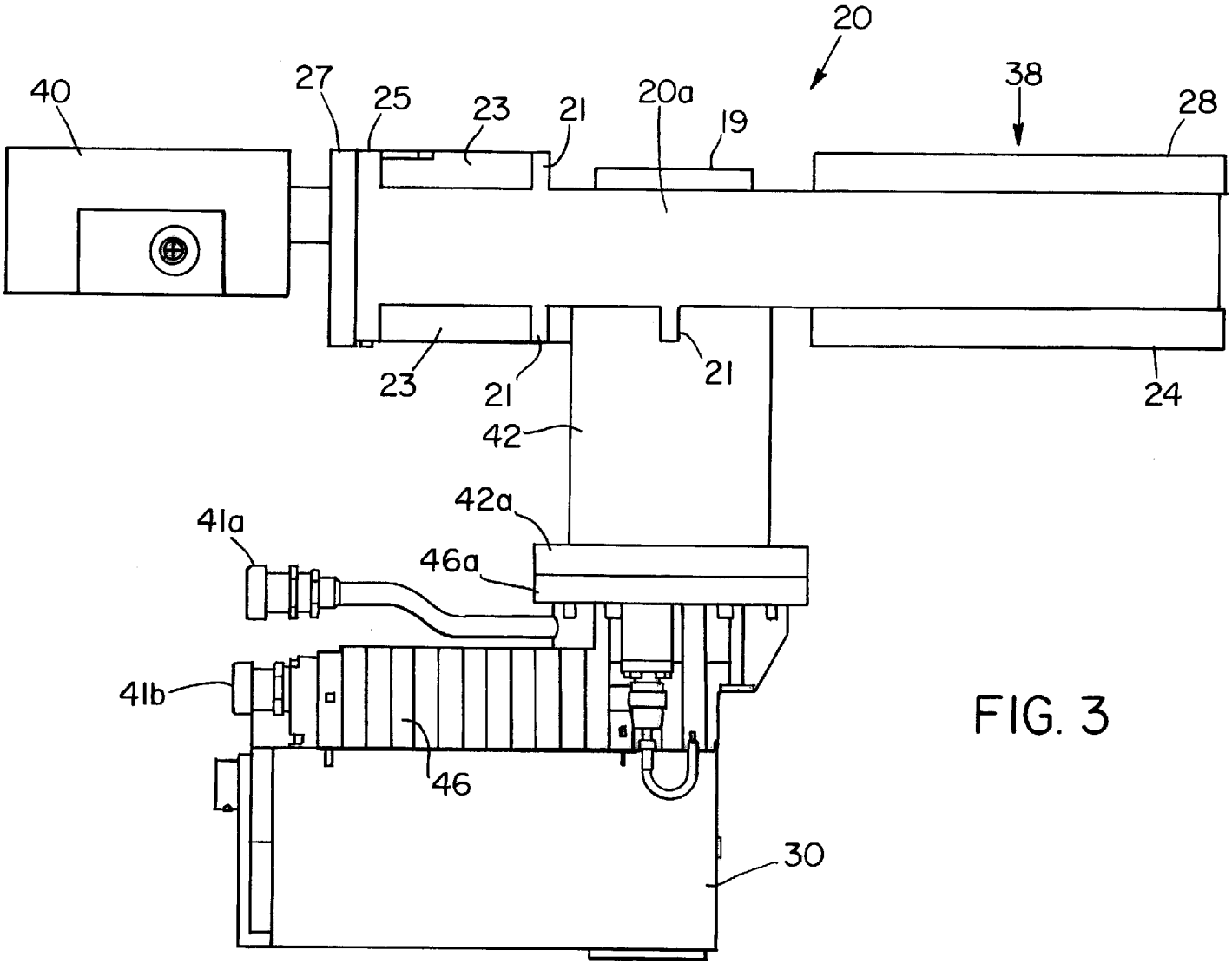
FIG. 3 is a side view of the present invention water pump.

Referring to FIGS. 1–5, the present invention cold trap is employed as a water pump 20. Water pump 20 includes an upstream flange 28 and a downstream flange 24 which are mounted to opposite sides of a gate valve housing 20*a*. A large portion of gate valve housing 20*a* extends laterally away from flanges 28 and 24 in a cantilevered fashion. A fluid conduit 38 having a fluid flow path extends through the upstream flange 28, gate valve housing 20*a* and the downstream flange 24 for allowing the passage of gases through water pump 20. Upstream flange 28 allows water pump 20 to be coupled to a process chamber 10 via process chamber flange 12, and downstream flange 24 allows water pump 20 to be coupled to a turbomolecular vacuum pump 22 via pump flange 26. A gate valve member 44 slides within gate valve housing 20*a* along a slide channel 32 for opening and closing the fluid conduit 38. Valve member 44 is operated by a solenoid 40 mounted to the end of gate valve housing 20*a*.

The use of an integral gate valve in water pump 20 eliminates the need for a separate gate valve unit to be coupled to water pump 20 for opening and closing fluid conduit 38. An optically open flat or planar cryopumping array 34 is positioned within fluid conduit 38 and extends along the perimeter of fluid conduit 38 for condensing water vapor thereon. Array 34 has a large centrally located circular opening 35 which provides little fluid resistance for non-condensing gases passing through fluid conduit 38 into turbomolecular pump 22. Array 34 is conductively coupled to and cooled to cryogenic temperatures by a cryogenic refrigerator 46 which is mounted to gate valve housing 20*a*. The operation of refrigerator 46 and turbomolecular pump 22 is controlled by a controller 30 which is mounted to refrigerator 46.

In operation, in order to evacuate process chamber 10, refrigerator 46 is turned on, cooling array 34 to cryogenic temperatures. Turbomolecular pump 22 also is turned on. Solenoid 40 moves valve member 44 into the open position so that process chamber 10 is in fluid flow communication with water pump 20 and turbomolecular pump 22. The rotating turbine blades of turbomolecular pump 22 now begin to capture gases from process chamber 10 through water pump 20. The non-condensing gases pass through array 34 while water vapor condenses on the surfaces of array 34. The non-condensing gases such as nitrogen and argon are pumped from the system by the turbine blades of turbomolecular pump 22. Periodically, when array 34 is saturated with condensed water vapor, valve member 44 is moved into the closed position (FIG. 5) closing off fluid conduit 38 and array 34 is regenerated to release the condensed water vapor.

Array 34 operates on the principle that gases passing through the central opening 35 in array 34 flow in molecular flow. Since gas molecules in molecular flow travel randomly in all directions, water vapor molecules passing through water pump 20 will hit and stick to both the upstream and downstream surfaces of array 34 with about the same probability. Array 34 is capable of trapping about 90% of the water vapor passing through water pump 20. If turbomolecular pump 22 is used without water pump 20, the water pumping speed is only about 10–20% efficient. The addition of water pump 20 to turbomolecular pump 22 increases the effective water pumping speed of the system by a minimum of 400%.

A more detailed discussion of the present invention now follows. Refrigerator 46 is preferably a conventional single stage Gifford-MacMahon refrigerator. A displacer is driven within cold finger 48 (FIGS. 4 and 5) by a motor driven mechanism for expanding refrigerant therein to cool the cold finger 48. The refrigerant is typically pressurized helium gas. The pressurized refrigerant gas is supplied to refrigerator 46 through inlet 41*a* and exhausted through outlet 41*b*. Refrigerator 46 has a flange 46*a* which is mounted to the flange 42*a* of a cylindrical vacuum vessel 42 extending from gate valve housing 20*a*. Vacuum vessel 42 extends from gate valve housing 20*a* proximate and parallel to turbomolecular pump 22. Cold finger 48 extends from refrigerator 46 through vacuum vessel 42 into gate valve housing 20*a*.

Figure 4:
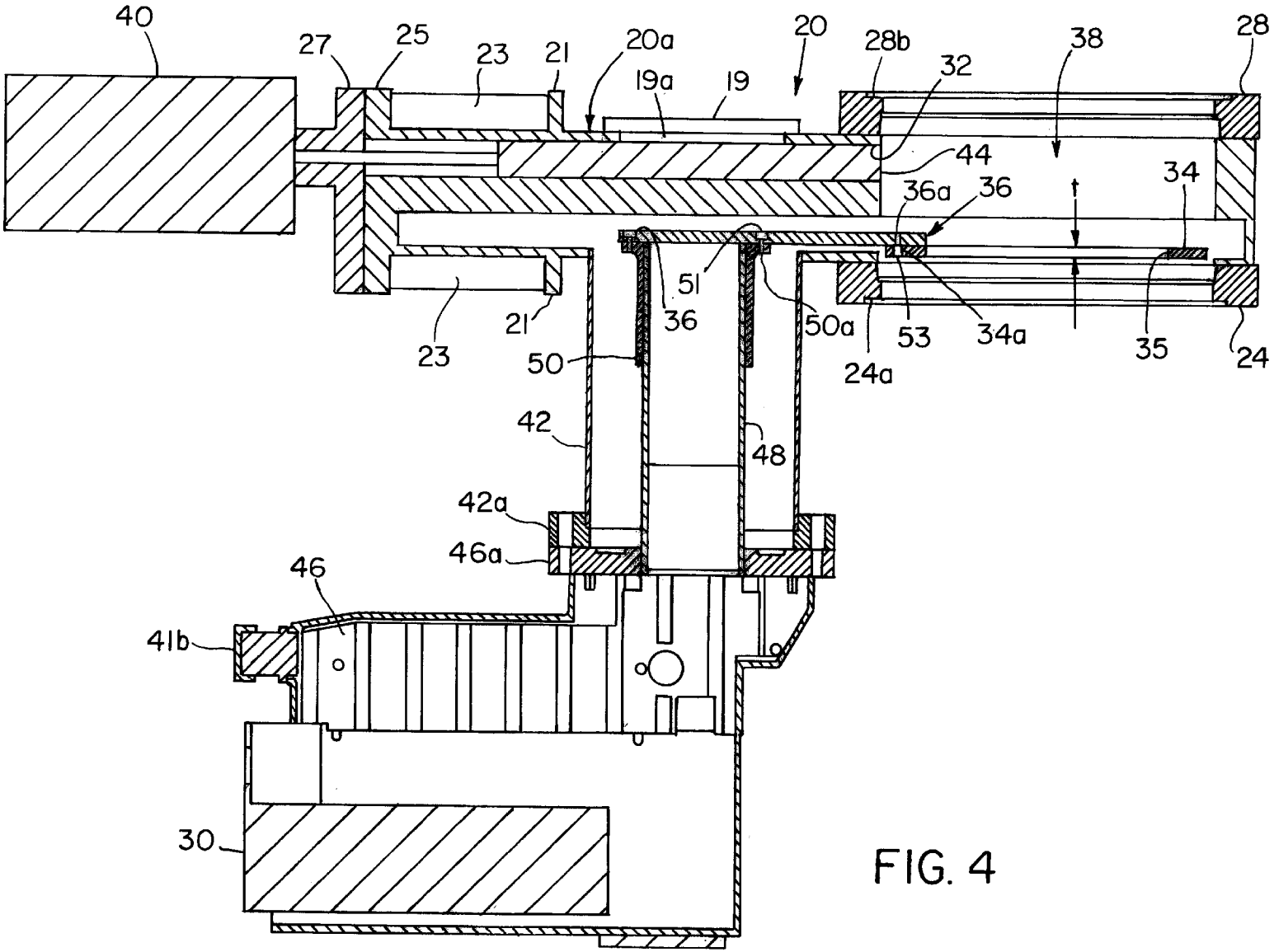
FIG. 4 is a simplified side sectional view of the present invention water pump.
Figure 5:
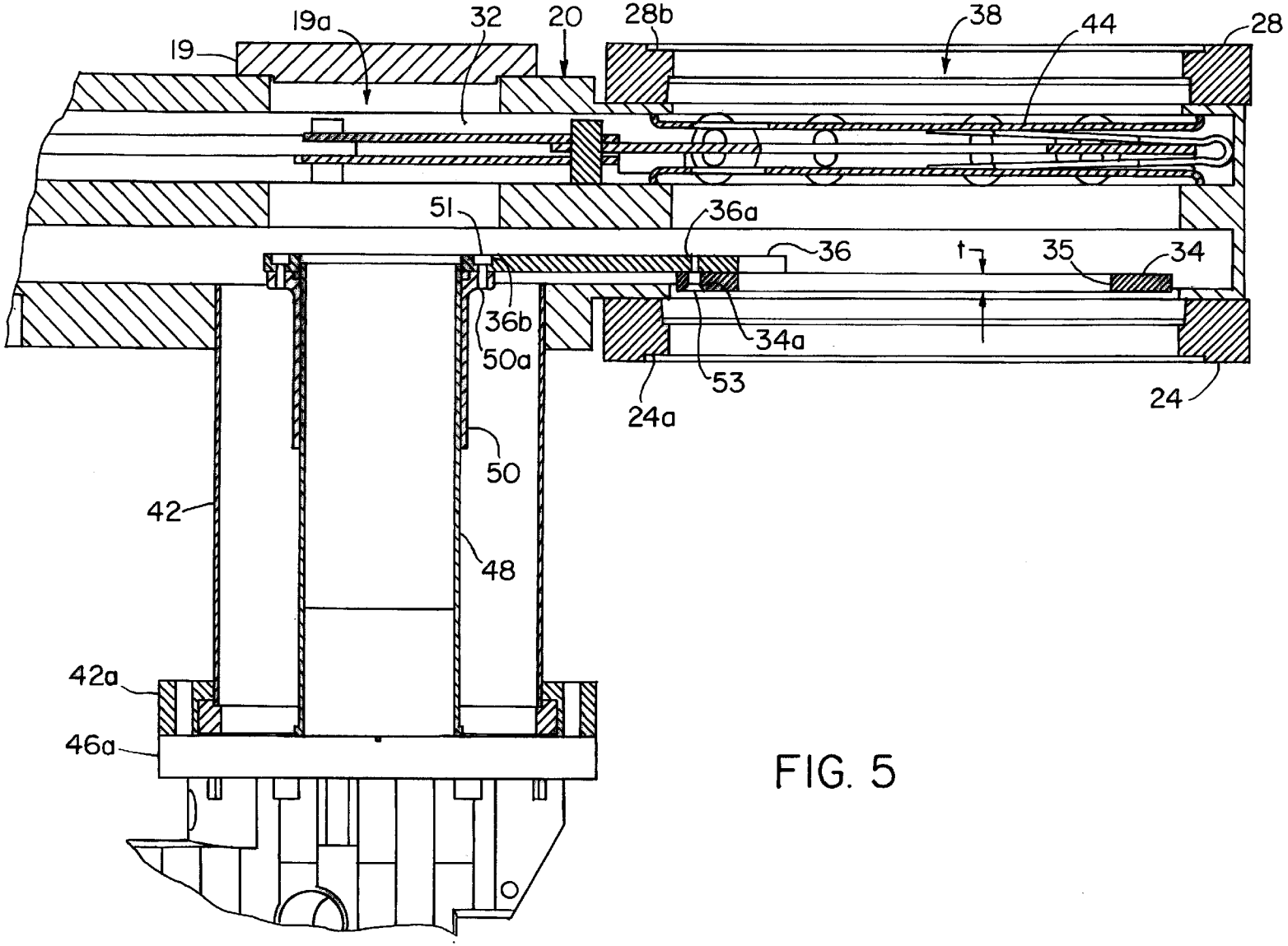
FIG. 5 is an enlarged partial side sectional view of the present invention water pump showing the gate valve with greater detail.
Figure 6:
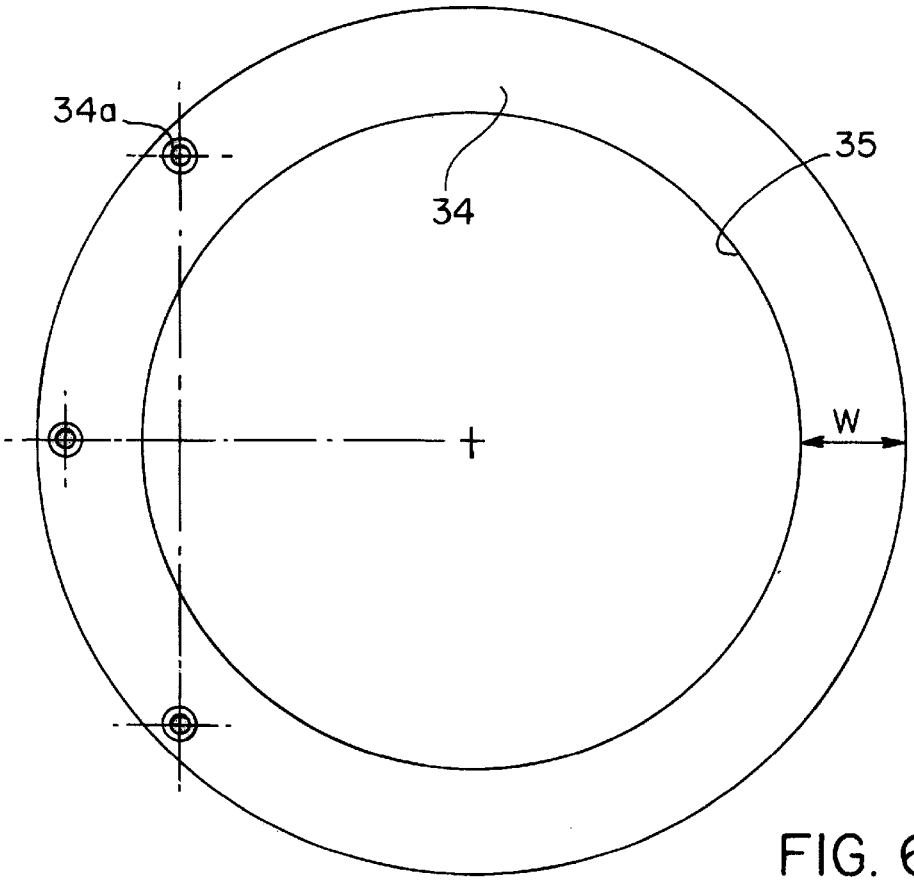
FIG. 6 is a plan view of the preferred cryopump array employed in the present invention.
Figure 7:
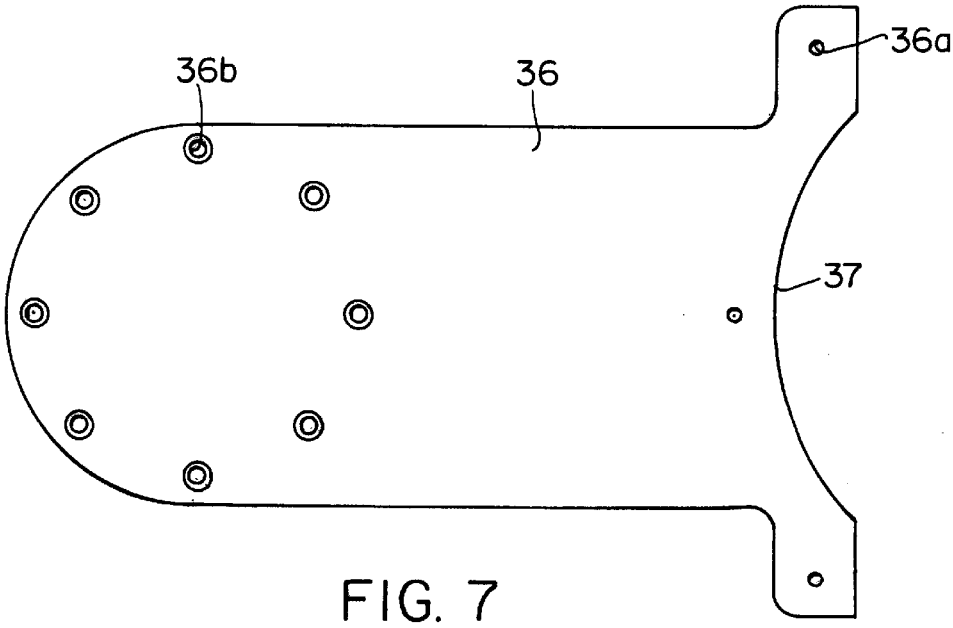
FIG. 7 is a plan view of the preferred conductive strut for conductively coupling the cryopump array to the cold finger of the cryogenic refrigerator.

Cryopumping array 34 is conductively coupled to the cold finger 48 of refrigerator 46 by a conductive strut 36 and an adapter sleeve 50 (FIGS. 4 and 5). Array 34 is mounted to strut 36 by screws 53 through holes 34*a* and 36*a* (FIGS. 6 and 7). Strut 36 is mounted to the end of adapter sleeve 50 by screws 51 through holes 36*b* and 50*a* such that strut 36 extends at a right angle to adapter sleeve 50. Strut 36 is preferably made from copper and is 0.25 inches thick. Strut 36 has a curved surface 37 for matching the contour of the opening 35 of array 34. Adapter sleeve 50 is also preferably copper and is fitted over the tip of cold finger 48.

Array 34 is positioned within fluid conduit 38 downstream from valve member 44. This allows array 34 to be isolated from process chamber 10 by valve member 44 for regeneration. The plane of array 34 is preferably perpendicular to the fluid flow path. The outer perimeter of array 34 is spaced inwardly from the inner wall of fluid conduit 38 preferably about 0.125 to 0.25 inches to avoid a thermal short with fluid conduit 38. By being optically open, array 34 provides little resistance to gases flowing over array 34 so that the pumping speed of vacuum pump 22 is not significantly affected. Opening 35 in array 34 is concentric with the outer diameter of array 34 which provides the outer rim of array 34 with a constant width W (FIG. 6) and maximizes the flow of gases therethrough. For pumping water, array 34 should be cooled to a temperature in the range of 90 k to 130 k with 107 k being the most preferable. Array 34 is formed from a sheet of conductive metal such as copper or aluminum and has a thickness t (FIGS. 4 and 5) between about 0.083 inches and 0.25 inches. It is most preferable for array 34 to be thin because 1) a thin array can cool faster than a thicker array and 2) a thin array has higher gas conductance. Although the thickness t of array 34 is preferably 0.25 inches or less, thicknesses t above 0.25 inches can be employed if required to provide the proper temperature gradient. Opening 35 is preferably circular but, alternatively, can be polygonal. In addition, array 34 can have angled or rippled surfaces instead of being flat. However, it is most preferable for array 34 to be flat so that the length of fluid conduit 38 is minimized.

Figure 8:
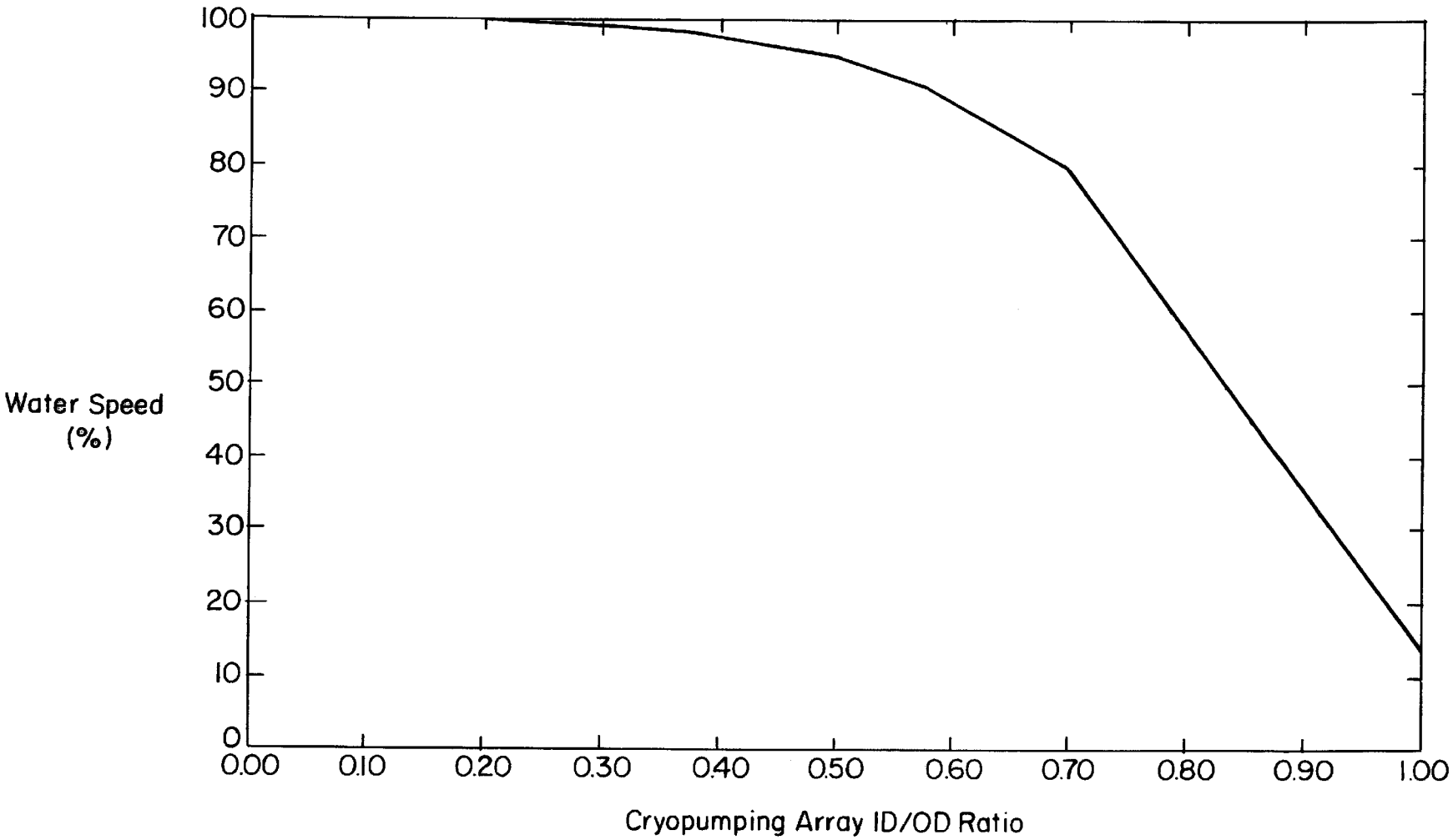
FIG. 8 is a graph depicting percent water speed as a function of the cryopumping array ID/OD ratio.
Figure 9:
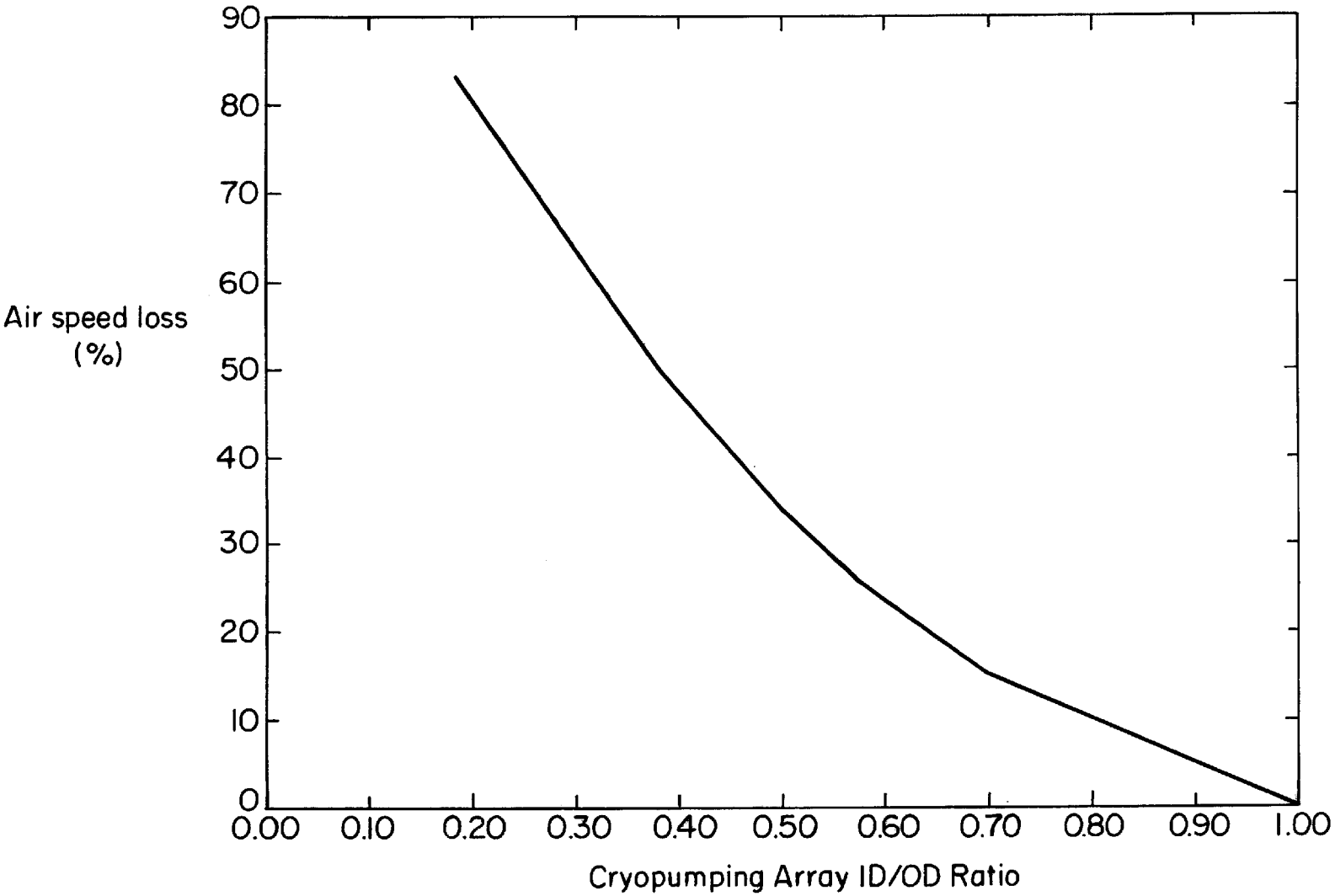
FIG. 9 is a graph depicting percent air speed reduction as a function of the cryopumping array ID/OD ratio.

The outer diameter (transverse width) of array 34 is dependent upon the diameter of fluid conduit 38 and can range from over 10 inches in diameter to only a few inches in diameter. The diameter of the opening 35 in array 34 can be varied to attain either a wide rim width W (FIG. 6) or a narrow rim width W. A wide rim width W results in a high water pumping speed but a low gas conductance. In contrast, a narrow rim width W results in a slower water pumping speed but a higher gas conductance through fluid conduit 38. In either case, the outer diameter and the rim width W are preferably greater in dimension than the thickness t. Array 34 has a preferable ID to OD ratio of about 0.6 to 0.8. Referring to FIGS. 8 and 9, it can be seen that this design offers water pumping speeds in the range of 60% to 90% of the maximum possible while only presenting a 10% to 20% loss in air speed. Water vapor is typically the more difficult gas to remove from the vacuum system whereas air is removed very quickly. In one example, array 34 has an outer diameter of 7.63 inches and an inside diameter of 5.43 inches. This results in an ID to OD ratio of 0.7 and can capture 80% of the available water vapor while only having a 15% effect on the performance of turbomolecular pump 22.

Gate valve housing 20*a*, valve member 44, flange 28 and flange 24 are preferably made of stainless steel or aluminum. Flanges 20*a* and 24 each have a recessed diameter 28*b* and 24*a* (FIGS. 4 and 5) respectively for receiving gaskets for sealing purposes. Holes 28*a* on flange 28 allow flange 28 to be secured to flange 12 of process chamber 10. In addition, flange 24 has similar holes for mounting to flange 26 of turbomolecular pump 22. Gate valve housing 20*a* generally has a long thin rectangular shape. A series of fins 21 and 23 provide structural stiffness to gate valve housing 20*a*. A flange 25 extends from the end of gate valve housing 20*a* which enables solenoid 40 to be mounted to gate valve housing 20*a* by coupling the flange 27 of solenoid 40 to flange 25. Gate valve housing 20*a* also includes an opening 19*a* which provides access to the end of cold finger 48. A removable cover plate 19 is mounted over opening 19*a*.

The compact design of water pump 20 provides water pump 20 with a fluid conduit 38 diameter to length ratio of 1.6. For example, an 8 inch diameter fluid conduit 38 has a length along the fluid flow path from the upstream flange 28 to the downstream flange 24 of about 5 inches. Consequently, the water pumping capabilities of the turbomolecular pump 22 can be greatly improved with only a minimal increase in the length of the fluid flow path between process chamber 10 and turbomolecular pump 22.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

Water pump 20, cryopump array 34 and strut 36 can have various dimensions depending on the diameter of the fluid conduit 38 and the application for which water pump 20 is used. In addition, fluid conduit 38 does not have to be circular in shape, but can be of other shapes such as polygonal. In such a case, the outer perimeter of array 34 can have a shape matching that of fluid conduit 38. Also, array 34 can be positioned before gate valve member 44. Furthermore, although a turbomolecular pump is preferably used in combination with water pump 20, water pump 20 can be coupled to other types of vacuum pumps such as a diffusion pump.

What is claimed is:

1. A cold trap comprising:

a fluid conduit having a fluid flow path therethrough, a length along the fluid flow path and a width transverse to the fluid flow path, the width of the fluid conduit being greater than the length;

a gate valve formed integrally with the fluid conduit for opening and closing the fluid flow path; and a cryopumping array having an outer rim surrounding a central opening positioned within the fluid conduit downstream from the gate valve and transverse to the fluid flow path such that the fluid flow path extends through said central opening, said outer rim for capturing water vapor from the fluid flow path.

2. The cold trap of claim 1 in which the array has a thickness, a transverse width and a rim width, both the transverse width and the rim width being greater than the thickness.

3. The cold trap of claim 2 in which the fluid conduit is coupled to a process chamber.

4. The cold trap of claim 3 in which the fluid conduit is coupled to a vacuum pump for drawing gas through the fluid conduit along the fluid flow path.

5. The cold trap of claim 4 in which the vacuum pump is a turbomolecular pump.

6. The cold trap of claim 1 in which the gate valve is solenoid operated.

7. The cold trap of claim 1 further comprising a cryogenic refrigerator for cooling the array.

8. The cold trap of claim 1 further comprising a conductive strut conductively coupling the refrigerator to the array.

9. The cold trap of claim 1 in which the array is a flat annular member formed from sheet metal.

10. The cold trap of claim 1 in which the array is optically open.

11. A cold trap comprising:

a fluid conduit having a fluid flow path therethrough, a length along the fluid flow path and a width transverse to the fluid flow path, the width of the fluid conduit being greater than the length;

a gate valve formed integrally with the fluid conduit for opening and closing the fluid flow path;

a cryopumping array comprising a flat annular member having an outer rim surrounding a central opening positioned within the fluid conduit downstream from the gate valve and transverse to the fluid flow path such that the fluid flow path extends through said central opening, said outer rim for capturing water vapor from the fluid flow path, the array having a thickness, a transverse width and a rim width, both the transverse width and the rim width being greater than the thickness; and a cryogenic refrigerator conductively coupled to the array by a conductive strut for cooling the array.

12. The cold trap of claim 11 in which the fluid conduit is coupled to a process chamber.

13. The cold trap of claim 12 in which the fluid conduit is coupled to a vacuum pump for drawing gas through the fluid conduit along the fluid flow path.

14. The cold trap of claim 13 in which the vacuum pump is a turbomolecular pump.

15. The cold trap of claim 11 in which the gate valve is solenoid operated.

16. The cold trap of claim 11 in which the array is optically open.

17. A method of trapping water vapor with a cold trap, the cold trap having a fluid conduit with a fluid flow path therethrough, a length along the fluid flow path and a width transverse to the fluid flow path, the width of the fluid conduit being greater than the length, the method comprising the steps of:

opening a gate valve formed integrally with the fluid conduit for opening the fluid flow path through the fluid conduit;

positioning a cryopumping array having an outer rim surrounding a central opening within the fluid conduit transverse to the fluid flow path such that the fluid flow path extends through said central opening; and cooling the array to cryogenic temperatures to capture water vapor from the fluid flow path on the outer rim of the array.

18. The method of claim 17 further comprising the step of providing the array with a thickness, a transverse width and a rim width, both the transverse width and the rim width being greater than the thickness.

19. The method of claim 17 further comprising the step of drawing gas through the fluid conduit with a vacuum pump coupled to the fluid conduit.

20. The method of claim 17 in which the step of opening the gate valve comprises operating the gate valve with a solenoid.

21. The method of claim 17 in which the step of cooling the cryopumping array comprises the steps of:

conductively coupling a cryogenic refrigerator to the array with a conductive strut; and cooling the strut and the array with the refrigerator.

* * * * *